US009978551B2

(12) United States Patent
Chen et al.

(10) Patent No.: US 9,978,551 B2
(45) Date of Patent: May 22, 2018

(54) CIRCUIT BREAKER

(71) Applicant: SENSATA TECHNOLOGIES, INC., Attleboro, MA (US)

(72) Inventors: Jian Chen, Shanghai (CN); Jianjun Fu, Jiangsu (CN); Wei Zhou, Jiangsu (CN)

(73) Assignee: Sensata Technologies, Inc., Attleboro, MA (US)

( * ) Notice: Subject to any disclaimer, the term of this patent is extended or adjusted under 35 U.S.C. 154(b) by 0 days. days.

(21) Appl. No.: 15/351,932

(22) Filed: Nov. 15, 2016

(65) Prior Publication Data

US 2017/0148598 A1 May 25, 2017

(30) Foreign Application Priority Data

Nov. 23, 2015 (CN) ..... 2015 1 0817655

(51) Int. Cl.

| | |
|---|---|
| ***H01H 73/12*** | (2006.01) |
| ***H01H 51/22*** | (2006.01) |
| ***H01H 71/46*** | (2006.01) |
| ***H01H 50/54*** | (2006.01) |

(52) U.S. Cl.

CPC ..... *H01H 51/2236* (2013.01); *H01H 50/545* (2013.01); *H01H 71/465* (2013.01)

(58) Field of Classification Search

CPC ..... H01H 71/465
USPC ..... 335/13, 17
See application file for complete search history.

(56) References Cited

U.S. PATENT DOCUMENTS

| | | | |
|---|---|---|---|
| 2,246,298 | A | 6/1941 | Dyer et al. |
| 2,439,511 | A | 4/1948 | Green |
| 3,198,906 | A | 8/1965 | Frink et al. |
| 4,042,894 | A | 8/1977 | Coleman |
| 4,276,457 | A | 6/1981 | Myers |
| 4,339,641 | A | 7/1982 | Noeske |
| 4,650,272 | A | 3/1987 | Doughty et al. |

(Continued)

FOREIGN PATENT DOCUMENTS

| | | | |
|---|---|---|---|
| CN | 102496535 | A | 6/2012 |
| CN | 203631438 | U | 6/2014 |

(Continued)

OTHER PUBLICATIONS

UK Search Report for GB Patent Application No. GB1618906.0 dated Apr. 12, 2017, 7 pages.

*Primary Examiner* — Ramon M Barrera
(74) *Attorney, Agent, or Firm* — Burns & Levinson, LLP; Joseph M. Maraia; Richard B. Emmons

(57) ABSTRACT

A circuit breaker having a first micro switch, a second micro switch and a transmission mechanism. The transmission mechanism drives the first micro switch and the second micro switch, which are arranged in a circuit breaker shell. The first micro switch and the second micro switch are arranged on one side of the shell side by side, and a corresponding first transmission rod and a corresponding second transmission rod in the transmission mechanism respectively drive the first micro switch and the second micro switch. Since the circuit breaker is provided with no external device, the space occupied by the circuit breaker is reduced, thereby facilitating construction and installation. Since the two micro switches are built-in side by side, different signals can be simultaneously output.

14 Claims, 4 Drawing Sheets

(56) References Cited

U.S. PATENT DOCUMENTS

| | | | | |
|---|---|---|---|---|
| 4,703,298 | A | 10/1987 | Gerson | |
| 4,716,265 | A | 12/1987 | Fujii et al. | |
| D293,779 | S | 1/1988 | Dantoft | |
| 4,789,848 | A | 12/1988 | Castonguay et al. | |
| D317,906 | S | 7/1991 | Winter et al. | |
| D325,192 | S | 4/1992 | Dubicki | |
| 5,148,910 | A | 9/1992 | Williams | |
| 5,313,180 | A | 5/1994 | Vial et al. | |
| 5,453,723 | A | 9/1995 | Fello et al. | |
| 5,510,759 | A | 4/1996 | Gula et al. | |
| 5,569,894 | A | 10/1996 | Uchida et al. | |
| 5,828,026 | A | 10/1998 | Bruhl et al. | |
| 5,902,978 | A | 5/1999 | Zehnder et al. | |
| 6,040,746 | A * | 3/2000 | Maloney | H01H 71/46 200/330 |
| 6,137,068 | A | 10/2000 | Padulo | |
| 6,160,227 | A | 12/2000 | Singer | |
| 6,232,859 | B1 | 5/2001 | Christensen et al. | |
| 6,239,962 | B1 | 5/2001 | Seymour et al. | |
| 6,545,574 | B1 | 4/2003 | Seymour et al. | |
| 7,268,654 | B2 | 9/2007 | Dorn et al. | |
| 7,459,652 | B2 | 12/2008 | Rival | |
| 7,863,534 | B2 | 1/2011 | Narayanasamy et al. | |
| 8,369,052 | B2 | 2/2013 | McCoy et al. | |
| 8,519,292 | B2 | 8/2013 | Domejean | |
| 9,349,559 | B2 | 5/2016 | DeBoer et al. | |
| 2005/0140479 | A1 | 6/2005 | Dorn et al. | |
| 2006/0028307 | A1 | 2/2006 | McCoy et al. | |
| 2009/0120908 | A1 | 5/2009 | Domejean | |
| 2009/0174508 | A1 | 7/2009 | Watford et al. | |
| 2009/0266793 | A1 | 10/2009 | Maloney et al. | |
| 2010/0020453 | A1 | 1/2010 | McCoy et al. | |
| 2011/0181379 | A1 | 7/2011 | Sohn | |
| 2012/0001721 | A1 | 1/2012 | Takeda | |
| 2015/0318136 | A1 | 11/2015 | DeBoer et al. | |
| 2016/0141846 | A1 | 5/2016 | Atchley et al. | |

FOREIGN PATENT DOCUMENTS

| | | | |
|---|---|---|---|
| DE | 3612251 | A1 | 10/1986 |
| DE | 3711138 | A1 | 10/1988 |
| DE | 9217024 | U1 | 2/1993 |
| DE | 102011118713 | A1 | 9/2012 |
| EP | 0128978 | A1 | 12/1984 |
| JP | 2002075136 | A | 3/2002 |
| JP | 2007280726 | A | 10/2007 |

* cited by examiner

CIRCUIT BREAKER

CROSS-REFERENCE TO RELATED APPLICATION

This application claims priority to Chinese Patent Application No. 201510817655.2 filed Nov. 23, 2015, which is incorporated herein by reference.

TECHNICAL FIELD

The present disclosure relates to the electrical field, and in particular, to circuit breakers.

BACKGROUND

Most current circuit breakers employ external micro switches, resulting in circuit breakers with a large volume and installation inconvenience. Additionally, due to the external mode, different micro switches cannot be effectively driven at the same time, so different signals cannot be effectively output.

SUMMARY

Embodiments of the present technology provide a circuit breaker. Two micro switches are arranged on one side within a circuit breaker shell side by side. The two micro switches are driven through a transmission mechanism arranged in the circuit breaker shell, since the circuit breaker is provided with no external device, the space occupied by the circuit breaker is reduced, thereby facilitating construction and installation. As a result of the two micro switches being built-in side by side, different signals can be simultaneously output. According to one aspect of the present disclosure, a circuit breaker is provided, including a circuit breaker shell, wherein a first micro switch, a second micro switch and a transmission mechanism used for driving the first micro switch and the second micro switch are arranged in the circuit breaker shell. The first micro switch and the second micro switch are arranged on one side of the shell side by side.

In one embodiment, the first micro switch is an alarm switch, and the transmission mechanism includes a first transmission rod rotatable around a first rotating shaft. When the first transmission rod is in a first alarm position, the first transmission rod does not trigger a contact of the alarm switch, and when the first transmission rod is in a second alarm position, the first transmission rod triggers the contact of the alarm switch, so that the alarm switch outputs an alarm signal.

In one embodiment, the transmission mechanism includes a rotary pin, wherein the rotary pin can be arranged in a first rotary position in which the circuit breaker is in an open state, a second rotary position in which the circuit breaker is in a tripping state and a third rotary position in which the circuit breaker is in a closed state.

In one embodiment, the transmission mechanism includes a handle and an alarm circuit, wherein when the handle is in an open position, the first transmission rod is in the first alarm position, the rotary pin is in the first rotary position, and when the rotary pin is in the first rotary position, the position of the handle is constrained by the rotary pin, and the alarm circuit is in an on state.

In one embodiment, the transmission mechanism includes an armature, and the alarm circuit includes a coil, wherein in the case of a fault of the circuit, a current flows through the coil to generate a magnetic force, the armature pushes the rotary pin into the second rotary position from the first rotary position under the magnetic force, and the rotary pin pushes the first transmission rod to rotate around the first rotating shaft, so that the first transmission rod rotates from the first alarm position to the second alarm position.

In one embodiment, when the rotary pin is in the second rotary position, the constraint on the position of the handle is removed, and the alarm circuit is in an off state.

In one embodiment, the transmission mechanism further includes a fixing part, wherein when the handle is not constrained by the rotary pin, the handle is fixed by the fixing part at a tripping position.

In another embodiment, when the handle arrives at a closed position from the tripping position by a manual operation, the handle drives the rotary pin into the third rotary position from the second rotary position, wherein when the rotary pin is in the third rotary position, the position of the handle is constrained by the rotary pin, and the alarm circuit is in the off state. When the rotary pin is in the third rotary position, the rotary pin does not provide a thrust for the first transmission rod any more, and the first transmission rod rotates back to the first alarm position from the second alarm position under a resilience force of the contact of the alarm switch.

In yet another embodiment, when the handle arrives at the open position from the closed position by the manual operation, the handle drives the rotary pin into the first rotary position from the third rotary position.

Preferably, the second micro switch is an auxiliary switch, the transmission mechanism further includes a linkage part and a second transmission rod, and the handle drives the second transmission rod through the linkage part. When the second transmission rod is in a first auxiliary position, the second transmission rod does not trigger the contact of the auxiliary switch, and when the second transmission rod is in a second auxiliary position, the second transmission rod triggers the contact of the auxiliary switch, so that the auxiliary switch outputs an auxiliary signal.

In one embodiment, the circuit breaker further includes a transmission part rotatable around a second rotating shaft. When the handle is in the open position, the second transmission rod is in the second auxiliary position and pushes the transmission part to rotate around the second rotating shaft, so as to trigger the contact of the auxiliary switch.

In a further embodiment, when the handle arrives at the tripping position from the open position, the second transmission rod arrives at the first auxiliary position from the second auxiliary position and does not provide a thrust for the transmission part any more, and the transmission part rotates around the second rotating shaft under the resilience force of the contact of the auxiliary switch and does not trigger the contact of the auxiliary switch any more.

In one embodiment, when the handle arrives at the closed position from the tripping position by the manual operation, the second transmission rod is in the first auxiliary position.

In a different embodiment, when the handle arrives at the open position from the closed position by the manual operation, the handle drives the second transmission rod to arrive at the second auxiliary position from the first auxiliary position through the linkage part.

It should be appreciated that the subject technology can be implemented and utilized in numerous ways, including without limitation as a process, an apparatus, a system, a device, a method for applications now known and later developed. These and other unique features of the system disclosed herein will become more readily apparent from the following description and the accompanying drawings.

BRIEF DESCRIPTION OF THE DRAWINGS

To illustrate technical solutions in the embodiments of the present disclosure or in the prior art more clearly, a brief introduction on the accompanying drawings which are needed in the description of the embodiments or the prior art is given below. The accompanying drawings in the description below are merely some of the embodiments of the present disclosure, and other drawings may also be obtained according to these drawings by those of ordinary skill in the art without any creative effort.

DETAILED DESCRIPTION OF THE EMBODIMENTS

Figure 1:
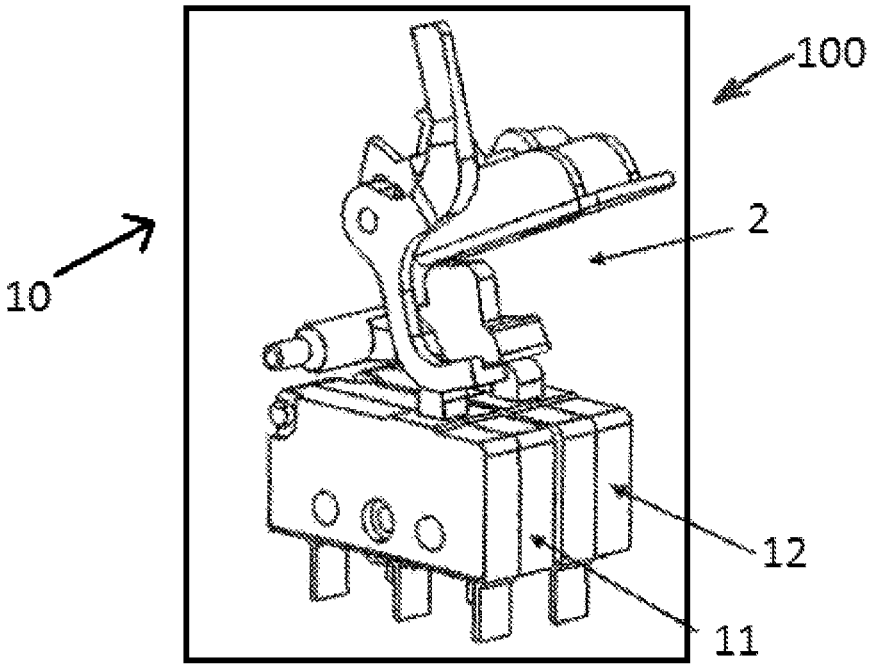
FIG. 1 is a schematic diagram of an embodiment of a circuit breaker of the present disclosure.

A clear and complete description of technical solutions in the embodiments of the present disclosure will be given below, in combination with the accompanying drawings in the embodiments of the present disclosure. The embodiments described below are merely a part, but not all, of the embodiments of the present disclosure. The description of at least one exemplary embodiment below is actually merely illustrative, and is in no way used as any limitation to the present disclosure and the application or use thereof. All of other embodiments obtained by those of ordinary skill in the art based on the embodiments of the present disclosure without any creative effort fall into the protection scope of the present disclosure.

Unless otherwise specified, the relative arrangements of the parts and steps, the numeric expressions and the numerical values described in these embodiments do not limit the scope of the present disclosure.

Meanwhile, it should be appreciated that, for convenience of description, sizes of the parts shown in the drawings are not drawn according to the actual proportional relationship.

The technologies, methods and devices that are known to those of ordinary skill in the art may not be discussed in detail, but the technologies, the methods and the devices should be deemed as a part of the description of the granted patent where appropriate.

In all the examples shown and discussed herein, any specific value should be interpreted as merely exemplary, rather than as a limitation. As a result, other examples of exemplary embodiments may have different values.

It should be noted that similar numerals and letters express similar items in the following drawings, and thus, once a certain item is defined in a drawing, the term does not need to be further discussed in the subsequent drawings.

FIG. 1 is a schematic diagram of an embodiment of a circuit breaker 100 of the present disclosure. As shown in FIG. 1, the circuit breaker 100 includes a circuit breaker shell 10, wherein a first micro switch 11, a second micro switch 12 and a transmission mechanism 2 used for driving the first micro switch 11 and the second micro switch 12 are arranged in the circuit breaker shell 10, wherein the first micro switch 11 and the second micro switch 12 are arranged on one side of the shell side by side.

For example, the transmission mechanism 2 can be arranged at the upper side, and the first micro switch 11 and the second micro switch 12 are arranged below the transmission mechanism 2 side by side.

According to the circuit breaker 100 provided by the embodiment of the present disclosure, the two micro switches 11, 12 are arranged on one side in the circuit breaker shell 10 side by side. The two micro switches 11, 12 are driven using the transmission mechanism 2 arranged in the circuit breaker shell 10, since the circuit breaker 100 is provided with no external device, a space occupied by the circuit breaker is reduced, thereby facilitating construction and installation. Since the two micro switches 11, 12 are built-in side by side, different signals can be simultaneously output.

Only a part of structures of the transmission mechanism 2 is shown in FIG. 1. The transmission mechanism 2 will be described in more detail below.

In one embodiment, the first micro switch 11 can be an alarm switch, and the second micro switch 12 can be an auxiliary switch.

Figure 2:
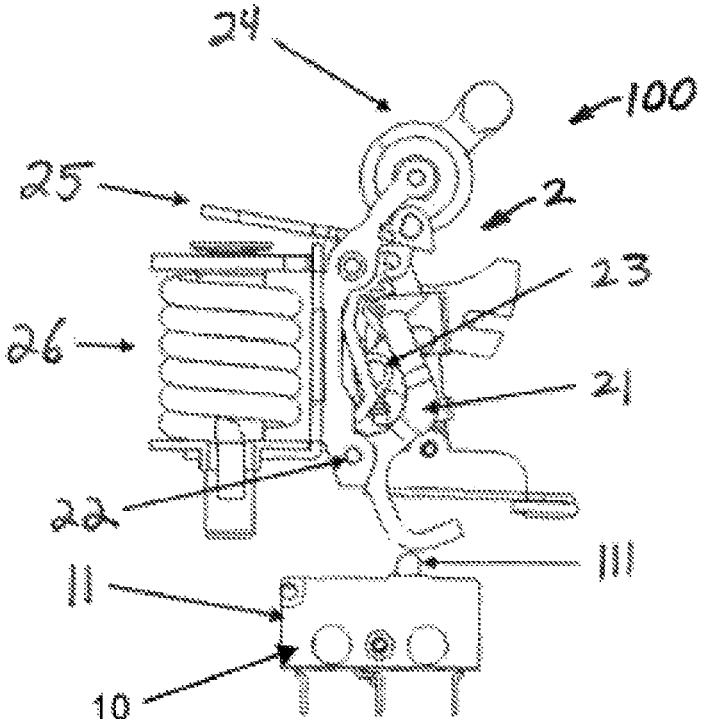
FIG. 2 is a schematic diagram of an embodiment of controlling an alarm switch when a handle is in an open position (i.e., first alarm position) in accordance with the present disclosure.

As shown in FIG. 2, the transmission mechanism 2 includes a first transmission rod 21, and the first transmission rod 21 can rotate around a first rotating shaft 22.

When the first transmission rod 21 is in a first alarm position, the first transmission rod 21 does not trigger a contact 111 of the alarm switch 11, as shown in FIG. 2. When the first transmission rod 21 is in a second alarm position, the first transmission rod 21 triggers the contact 111 of the alarm switch 11, so that the alarm switch 11 outputs an alarm signal, as shown in FIG. 3.

In one embodiment, the transmission mechanism 2 further includes a rotary pin 23. The rotary pin 23 can be arranged in a first rotary position in which the circuit breaker 100 is in an open state, a second rotary position in which the circuit breaker 100 is in a tripping state and a third rotary position in which the circuit breaker 100 is in a closed state.

The transmission mechanism 2 further includes a handle 24, an armature 25 and an alarm circuit 9. The alarm circuit 9 includes a coil 26. When the handle 24 is in an open position (FIG. 2), the first transmission rod 21 is in the first alarm position, and the rotary pin 23 is in the first rotary position. When the rotary pin 23 is in the first rotary position, the position of the handle 24 is constrained by the rotary pin 23, and the alarm circuit 9 is in an on state, as shown in FIG. 2. Since the alarm circuit 9 is known to those skilled in the art, it will not be described herein.

Figure 3:
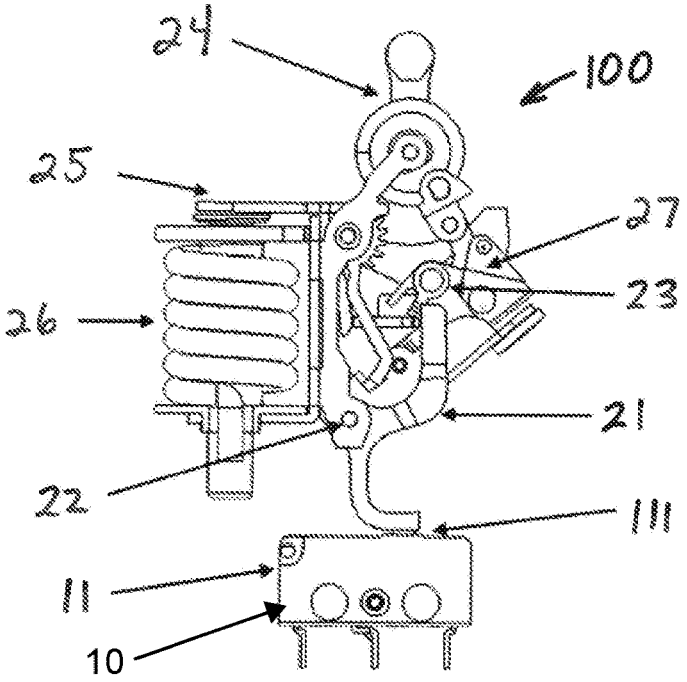
FIG. 3 is a schematic diagram of an embodiment of controlling an alarm switch when a handle is in a tripping position (i.e., second alarm position) in accordance with the present disclosure.

In the case that a fault occurs in the circuit (not shown), a current flows through the coil 26 to generate a magnetic force, the armature 25 pushes the rotary pin 23 into the second rotary position from the first rotary position under the magnetic force, and the rotary pin 23 pushes the first transmission rod 21 to rotate around the first rotating shaft 22, so that the first transmission rod 21 rotates from the first alarm position to the second alarm position, to trigger the contact 111 of the alarm switch 11, as shown in FIG. 3.

When the rotary pin 23 is in the second rotary position, the constraint on the position of the handle 24 is removed, and the alarm circuit 9 is in an off state.

Since the alarm circuit 9 is switched to the off state, the magnetic force generated by the coil 26 disappears. Meanwhile, since the handle 24 is not constrained by the rotary pin 23 any more, the handle will move from the open position to the closed position, and a fixing part 27 in the transmission mechanism 2 fixes the handle 24 to a tripping position, as shown in FIG. 3.

It should be noted that, the fixing part 27 fixes the handle 24 to the tripping position only when the circuit breaker 100 is in the tripping state, and the handle 24 can arrive at the closed position from the tripping position when the handle 24 is manually operated. Preferably, the fixing part 27 can be a copper clip or a similar fixing device.

When the handle 24 arrives at the closed position from the tripping position by manual operation, the handle 24 brings the rotary pin 23 into the third rotary position from the second rotary position, wherein when the rotary pin 23 is in the third rotary position, the position of the handle 24 is constrained by the rotary pin 23, and the alarm circuit 9 is in the off state.

Figure 4:
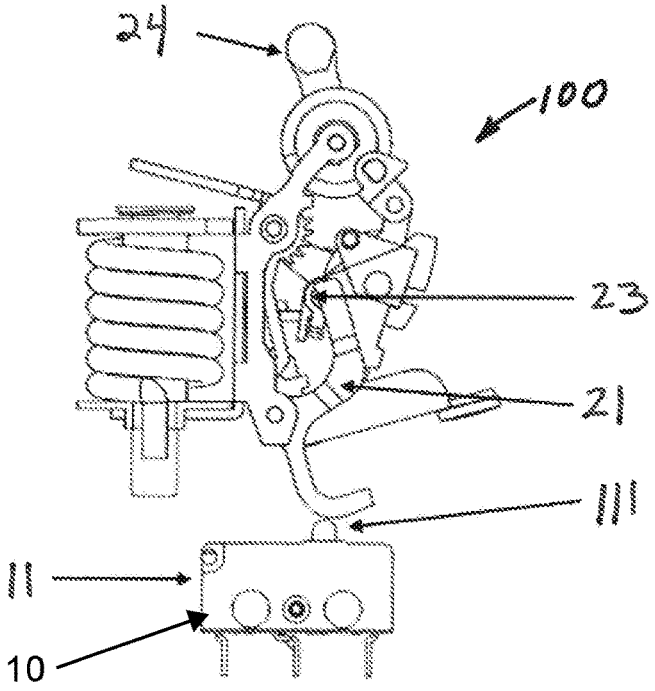
FIG. 4 is a schematic diagram of an embodiment of controlling an alarm switch when a handle is in a closed position in accordance with the present disclosure.

When the rotary pin 23 is in the third rotary position, the rotary pin 23 does not provide a thrust for the first transmission rod 21 any more, so the first transmission rod 21 rotates back to the first alarm position from the second alarm position under a resilience force of the contact 111 of the alarm switch 9, as shown in FIG. 4.

When the handle 24 arrives at the open position from the closed position by manual operation, the handle 24 brings the rotary pin 23 into the first rotary position from the third rotary position, and at this time, the circuit breaker 100 returns to the state as shown in FIG. 2, namely, the handle 24 is in the open position, the rotary pin 23 is in the first rotary position, and the alarm circuit 9 is in an on state. In the case that a fault occurs in the circuit, the alarm circuit 9 can continue to carry out a corresponding alarm operation.

Figure 5:
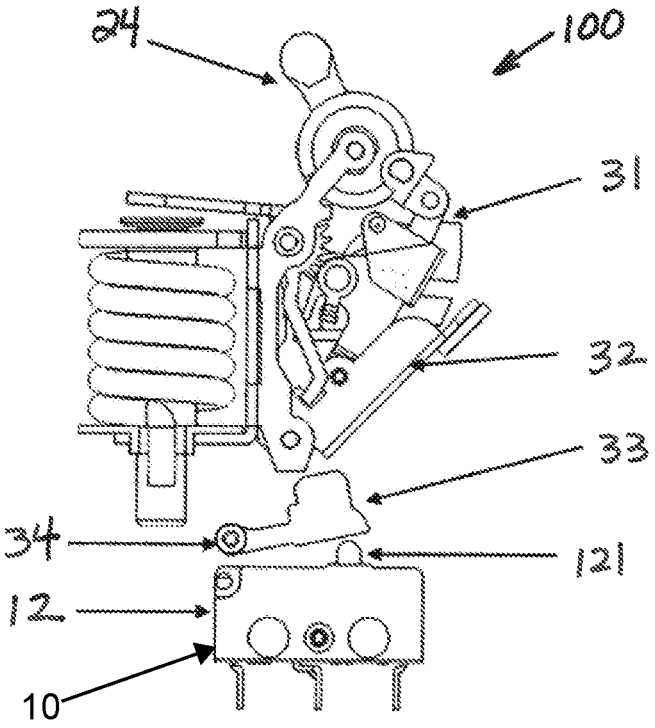
FIG. 5 is a schematic diagram of an embodiment of controlling an auxiliary switch when a handle is in a closed position in accordance with the present disclosure.

As shown in FIG. 5, the transmission mechanism 2 further includes a linkage part 31 and a second transmission rod 32. The handle 24 drives the second transmission rod 32 through the linkage part 31.

Figure 6:
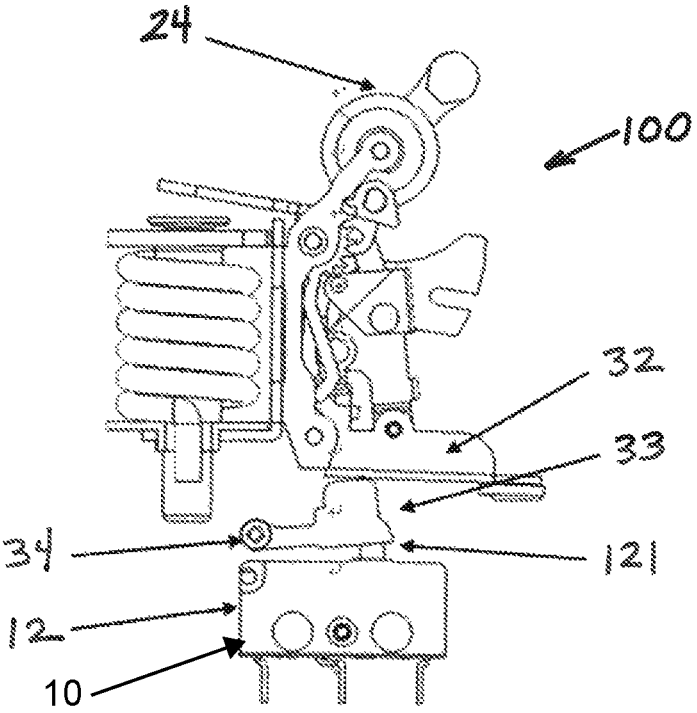
FIG. 6 is a schematic diagram of an embodiment of controlling an auxiliary switch when a handle is in an open position in accordance with the present disclosure.

When the second transmission rod 32 is in a first auxiliary position, the second transmission rod 32 does not trigger the contact 121 of the auxiliary switch 12, as shown in FIG. 5. When the second transmission rod 32 is in a second auxiliary position, the second transmission rod 32 triggers the contact 121 of the auxiliary switch 12, so that the auxiliary switch 12 outputs an auxiliary signal, as shown in FIG. 6.

Preferably, the transmission mechanism 2 further includes a transmission part 33, and the transmission part 33 can rotate around a second rotating shaft 34. When the handle 24 is in the open position, the second transmission rod 32 is in the second auxiliary position and pushes the transmission part 33 to rotate around the second rotating shaft 34, so as to trigger the contact 121 of the auxiliary switch 12, as shown in FIG. 6.

Figure 7:
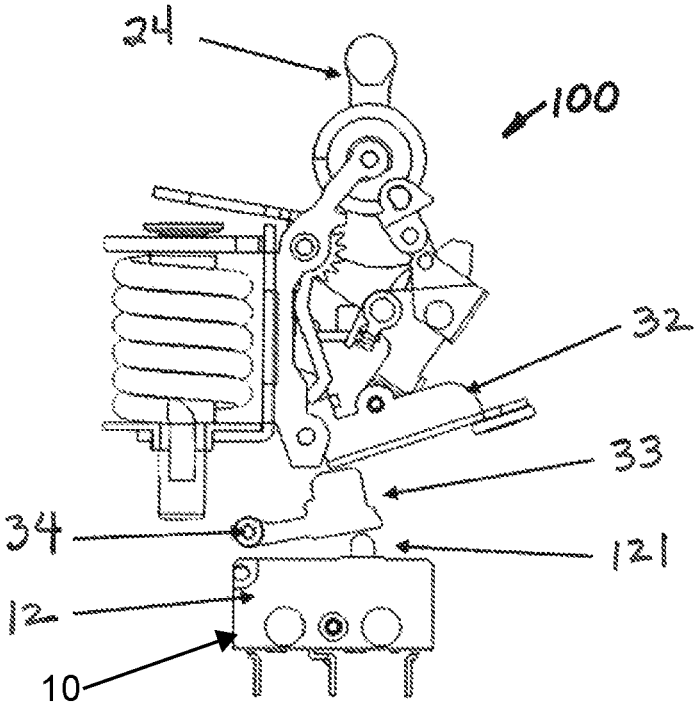
FIG. 7 is a schematic diagram of an embodiment of controlling an auxiliary switch when a handle is in a tripping position in accordance with the present disclosure.

Specifically, when the handle 24 arrives at the tripping position from the open position, the second transmission rod 32 arrives at the first auxiliary position from the second auxiliary position and does not provide a thrust for the transmission part any more, and the transmission part 33 rotates around the second rotating shaft 34 under the resilience force of the contact 121 of the auxiliary switch and does not trigger the contact 121 of the auxiliary switch 12 any more, as shown in FIG. 7.

When the handle 24 arrives at the closed position from the tripping position by the manual operation, the second transmission rod 32 is still in the first auxiliary position, as shown in FIG. 5.

When the handle 24 arrives at the open position from the closed position by the manual operation, the handle 24 drives the second transmission rod 32 to arrive at the second auxiliary position from the first auxiliary position through the linkage part 31, so as to trigger the contact 121 of the auxiliary switch 12 through the transmission part 33, as shown in FIG. 6.

By implementing the present disclosure, the two micro switches 11, 12 are arranged on one side in the circuit breaker shell 10 side by side, meanwhile, the two micro switches 11, 12 are driven using the transmission mechanism 2 arranged in the circuit breaker shell 10, since the circuit breaker 100 is provided with no external device, the space occupied by the circuit breaker is reduced, thereby facilitating construction and installation, and meanwhile, since the two micro switches 11, 12 are built-in side by side, different signals can be simultaneously output.

It should be noted that, since the alarm switch and the auxiliary switch are known to those skilled in the art, the corresponding alarm signal and the auxiliary signal transmission are not described in detail.

The description of the present disclosure is given for exemplification and description, rather than being exhaustive or limiting the present disclosure to the disclosed form. A lot of modifications and changes are obvious to those of ordinary skill in the art. The embodiments are selected and described to better illustrate the principle and practical applications of the present disclosure, and to make those of ordinary skill in the art understand the present disclosure to design various embodiments with various modifications suitable for specific uses.

It will be appreciated by those of ordinary skill in the pertinent art that the functions of several elements may, in alternative embodiments, be carried out by fewer elements, or a single element. Similarly, in some embodiments, any functional element may perform fewer, or different, operations than those described with respect to the illustrated embodiment. Also, functional elements shown as distinct for purposes of illustration may be incorporated within other functional elements in a particular implementation. While the subject technology has been described with respect to preferred embodiments, those skilled in the art will readily appreciate that various changes and/or modifications can be made to the subject technology without departing from the spirit or scope of the invention as defined by the appended claims.

What is claimed is:

1. A circuit breaker comprising:

a circuit breaker shell;

a first micro switch arranged in the circuit breaker shell;

a second micro switch arranged in the circuit breaker shell, wherein the first micro switch and the second micro switch are arranged side by side on one side of the circuit breaker shell; and a transmission mechanism configured to drive the first micro switch and the second micro switch, the transmission mechanism including a handle, a first rotating shaft, a first transmission rod rotatable around the first rotating shaft and configured to move between a first position in which the first transmission rod does not trigger a contact of the first micro switch and a second position in which the first transmission rod triggers the contact of the first micro switch, a rotary pin having a first rotary position in which the circuit breaker is in an open state, a second rotary position in which the circuit breaker is in a tripping state, and a third rotary position in which the circuit breaker is in a closed state, an armature configured to push the rotary pin from the first rotary position to the second rotary position, wherein the rotary pin pushes the first transmission rod to rotate around the first rotating shaft from the first position to the second position as the rotary pin moves from the first rotary position to the second rotary position, and an alarm circuit including a coil, wherein a current flows through the coil to generate a magnetic force when there is a fault in the circuit, and the magnetic force triggers the armature to push the rotary pin from the first rotary position to the second rotary position.

2. The circuit breaker of claim 1, wherein the first micro switch is an alarm switch, and when the first transmission rod is in the second position, the first transmission rod triggers the contact of the alarm switch to output an alarm signal.

3. The circuit breaker of claim 2, wherein when the handle is in an open position, the first transmission rod is in a first alarm position and the rotary pin is in the first rotary position; and when the rotary pin is in the first rotary position, the position of the handle is constrained by the rotary pin and the alarm circuit is in an on state.

4. The circuit breaker of claim 3, wherein when the rotary pin is in the second rotary position, a constraint on the position of the handle is removed, and the alarm circuit is in an off state.

5. The circuit breaker of claim 4, wherein the transmission mechanism further comprises a fixing part, and when the handle is not constrained by the rotary pin, the handle is fixed by the fixing part in a tripping position.

6. The circuit breaker of claim 5, wherein when the handle arrives at a closed position from the tripping position by a manual operation, the handle brings the rotary pin into the third rotary position from the second rotary position;

when the rotary pin is in the third rotary position, the position of the handle is constrained by the rotary pin, and the alarm circuit is in the off state; and when the rotary pin is in the third rotary position, the rotary pin does not provide a thrust for the first transmission rod, and the first transmission rod rotates back to the first alarm position from a second alarm position under a resilient force of the contact of the alarm switch.

7. The circuit breaker of claim 6, wherein when the handle arrives at the open position from the closed position by the manual operation, the handle brings the rotary pin into the first rotary position from the third rotary position.

8. The circuit breaker of claim 1, wherein the second micro switch is an auxiliary switch, the transmission mechanism further comprises a linkage part and a second transmission rod, and the handle drives the second transmission rod through the linkage part, so that:

when the second transmission rod is in a first auxiliary position, the second transmission rod does not trigger the contact of the auxiliary switch; and when the second transmission rod is in a second auxiliary position, the second transmission rod triggers the contact of the auxiliary switch, so that the auxiliary switch outputs an auxiliary signal.

9. The circuit breaker of claim 8, further comprising a transmission part rotatable around a second rotating shaft, wherein when the handle is in the open position, the second transmission rod is in the second auxiliary position and pushes the transmission part to rotate around the second rotating shaft, so as to trigger the contact of the auxiliary switch.

10. The circuit breaker of claim 9, wherein when the handle arrives at the tripping position from the open position, the second transmission rod arrives at the first auxiliary position from the second auxiliary position and does not provide a thrust for the transmission part any more, and the transmission part rotates around the second rotating shaft under the resilient force of the contact of the auxiliary switch and does not trigger the contact of the auxiliary switch.

11. The circuit breaker of claim 10, wherein when the handle arrives at the closed position from the tripping position by a manual operation, the second transmission rod is in the first auxiliary position.

12. The circuit breaker of claim 11, wherein when the handle arrives at the open position from the closed position by the manual operation, the handle drives the second transmission rod to arrive at the second auxiliary position from the first auxiliary position through the linkage part.

13. A circuit breaker comprising:

a first micro alarm switch;

a second micro auxiliary switch, wherein the first micro alarm switch and the second micro auxiliary switch are arranged side by side; and a transmission mechanism for selectively driving the first micro alarm switch and the second micro auxiliary switch, the transmission mechanism including a handle, a first rotating shaft, a first transmission rod rotatable around the first rotating shaft and configured to move between a first position in which the first transmission rod does not trigger a contact of the first micro alarm switch and a second position in which the first transmission rod triggers the contact of the first micro alarm switch, which outputs an alarm signal, a linkage part, a second transmission rod, wherein the handle moves the second transmission rod through the linkage part between a first auxiliary position in which the second transmission rod does not trigger a contact of the second micro auxiliary switch and a second auxiliary position in which the second transmission rod triggers the contact of the second micro auxiliary switch, which outputs an auxiliary signal; and an alarm circuit including a coil, wherein a current flows through the coil to generate a magnetic force when there is a fault in the circuit, and the magnetic force triggers an armature configured to push a rotary pin from the first rotary position in which the circuit breaker is in an open state and a second rotary position in which the circuit breaker is in a tripping state, wherein the rotary pin pushes the first transmission rod to rotate around the first rotating shaft from the first position to the second position as the rotary pin moves from the first rotary position to the second rotary position.

14. A circuit breaker comprising:

a first micro switch;

a second micro switch, wherein the first micro switch and the second micro switch are arranged side by side; and a transmission mechanism arranged to selectively drive the first micro switch and the second micro switch, wherein the transmission mechanism includes a rotary pin arranged in a first rotary position when the circuit breaker is in an open state, a second rotary position when the circuit breaker is in a tripping state, and a third rotary position when the circuit breaker is in a closed state, wherein the transmission mechanism further includes a handle and an alarm circuit configured so that when the handle is in an open position, a first transmission rod is in a first position and the rotary pin is in the first rotary position, and when the rotary pin is in the first rotary position, the position of the handle is constrained by the rotary pin and the alarm circuit is in an on state; and wherein the transmission mechanism further comprises an armature and the alarm circuit includes a coil, wherein a current flows through the coil to generate a magnetic force when there is a fault in the circuit, and the magnetic force triggers the armature to push the rotary pin from the first rotary position in which the circuit breaker is in an open state to the second rotary position in which the circuit breaker is in a tripping state, wherein the rotary pin pushes the first transmission rod to rotate around the first rotating shaft from the first position to the second position as the rotary pin moves from the first rotary position to the second rotary position.

* * * * *